United States Patent [19]

Brewer

[11] 3,993,116

[45] Nov. 23, 1976

[54] RASP SHARPENER

[75] Inventor: Donaldee Brewer, Muscatine, Iowa

[73] Assignee: Bandag, Incorporated, Muscatine, Iowa

[22] Filed: Mar. 27, 1975

[21] Appl. No.: 562,687

[52] U.S. Cl. ..... 157/13; 51/248; 82/49

[51] Int. Cl.[2] ..... B29H 21/00; B24B 3/60

[58] Field of Search ..... 51/168, 241 R, 241 S, 51/242, 243, 248, 251, 254; 83/174, 174.1; 76/85; 56/250; 157/13; 82/49

[56] References Cited

UNITED STATES PATENTS

| | | | |
|---|---|---|---|
| 1,050,915 | 1/1913 | Brawley | 51/251 |
| 1,169,377 | 1/1916 | Barnhart | 51/251 |
| 1,467,791 | 9/1923 | Hood | 51/248 |
| 1,891,661 | 12/1932 | Binns | 51/105 R X |
| 2,014,327 | 9/1935 | Hargrave | 51/168 X |
| 2,467,027 | 4/1949 | Glandis | 51/251 |
| 3,813,821 | 6/1974 | Takahashi | 51/105 R X |

*Primary Examiner*—Al Lawrence Smith
*Assistant Examiner*—Nicholas P. Godici
*Attorney, Agent, or Firm*—Cushman, Darby & Cushman

[57] ABSTRACT

A sharpening device for the rotatable cutting rasp of a tire buffing machine comprises a cylindrical rotatable sharpening stone carried at the free end of an arm which is pivoted to the frame of the machine to allow the operator to bring the stone into contact with the rotating rasps. Engagement of the edge of the rasp with the periphery of the stone causes the stone to rotate at lower speed than the rasp due to an adjustable spring-biased brake acting on the stone. An adjustable stop arrangement prevents over-sharpening.

9 Claims, 3 Drawing Figures

RASP SHARPENER

This invention relates to an abrasive sharpening device for sharpening the cutting edges of a rotary rasp in a tire buffing machine.

In the tire retreading art one of the preliminary steps in preparing a tire for being retreaded is to grind or cut away rubber from the periphery of the tire so as to remove old tread and to produce a uniform rough surface for receiving the new tread. Conventionally this operation is carried out on a tire buffing machine which includes a power driven rotary rasp against which the periphery of the tire is pressed as the tire is rotated about its axis. Typically a rasp comprises a hub of perhaps 6 inches in diameter to the surface of which are attached a plurality of spaced-apart blades or teeth set at an oblique angle to the axis of the hub. The blades or teeth require periodic sharpening and in the past this has often been accomplished with a hand held abrasive sharpening stone, the procedure being to turn the rasp on and then off and to hold the stone against the teeth as the rasp slows down. This method is dangerous to the operator and may result in uneven sharpening of the teeth.

The present invention provides a rasp sharpening device for tire buffing machines which includes a cylindrical abrasive sharpening stone mounted for rotation about its axis on one end of an arm the other end of which is pivoted to the machine frame. In use the arm and the stone are swung by an operator without danger to himself into a preselected position in which the periphery of the stone engages the rotating rasp in a manner to sharpen the rasp teeth while being rotated by the moving teeth. An adjustable brake or drag mechanism is provided to enable the operator to adjustably reduce the speed of the stone to considerably below the speed of the rasp thereby providing control over the degree of grinding action so as to achieve uniform sharpening. Rotation of the stone during use also provides for uniform wear of the stone. Preferably the pivot connection between the arm and the machine is easily releasable so that the sharpening device can be removed and stored when not in use. An adjustable stop assembly between the machine frame and the arm prevents the arm from swinging the stone too far toward the rasp thereby avoiding over-sharpening of the teeth.

In a preferred form the brake assembly includes thrust bearings at each end of the stone and means for applying an adjustable spring-biased force to the bearing components.

Rotatably mounted sharpening stones have been used in the past for sharpening a circular blade in a bread slicing machine (U.S. Pat. No. 1,467,791) and for sharpening the slitting blade of a fabric slitting machine (U.S. Pat. No. 3,736,825). Neither of these prior patents recognizes the advantages of the adjustable drag arrangement of the present invention and neither teaches the combinations of features in a tire buffing machine which are regarded as forming part of the present invention.

The invention will be further understood from the following more detailed description of an exemplary embodiment taken with the drawings in which.

Figure 1:
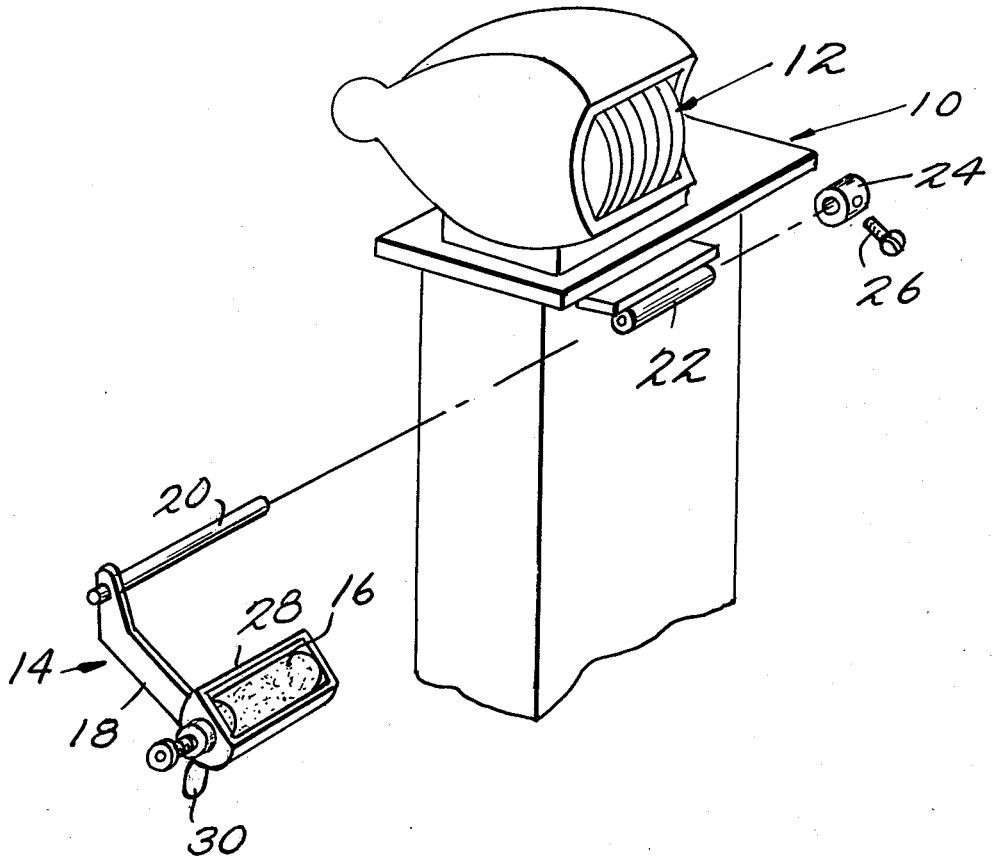
FIG. 1 is a schematic perspective view of a tire buffing machine which includes a rasp sharpener embodying the principles of the invention.

In FIG. 1 there is illustrated schematically a portion of tire buffing machine including a frame 10 and a motor driven rotary rasp 12 supported on the frame 10. A rasp sharpening assembly 14 embodying the principles of the invention includes a rotatably cylindrical abrasive stone 16 carried at one end of an arm 18 which is adapted to be pivotally mounted on the frame 10 so that the periphery of the stone 16 can be brought into engagement with the teeth of the rasp. Mounting is effected by means of a shaft 20 fixed to the other end of the arm 18 and inserted into a tubular sleeve 22 which is fixed to the frame 10. A collar 24 and set screw 26 retain the shaft 20 in the sleeve 22 when the device is in use but allow easy detachment when the device is to be stored. A safety guard 28 is provided around the stone 16 and a handle 30 allows the operator of the machine to swing the arm from its inoperative position, as illustrated, counterclockwise into a sharpening position in which the periphery of the stone 16 engages the rasp teeth. The axes of the stone 16, the rasp 12 and the pivot shaft 20 are parallel.

Figure 2:
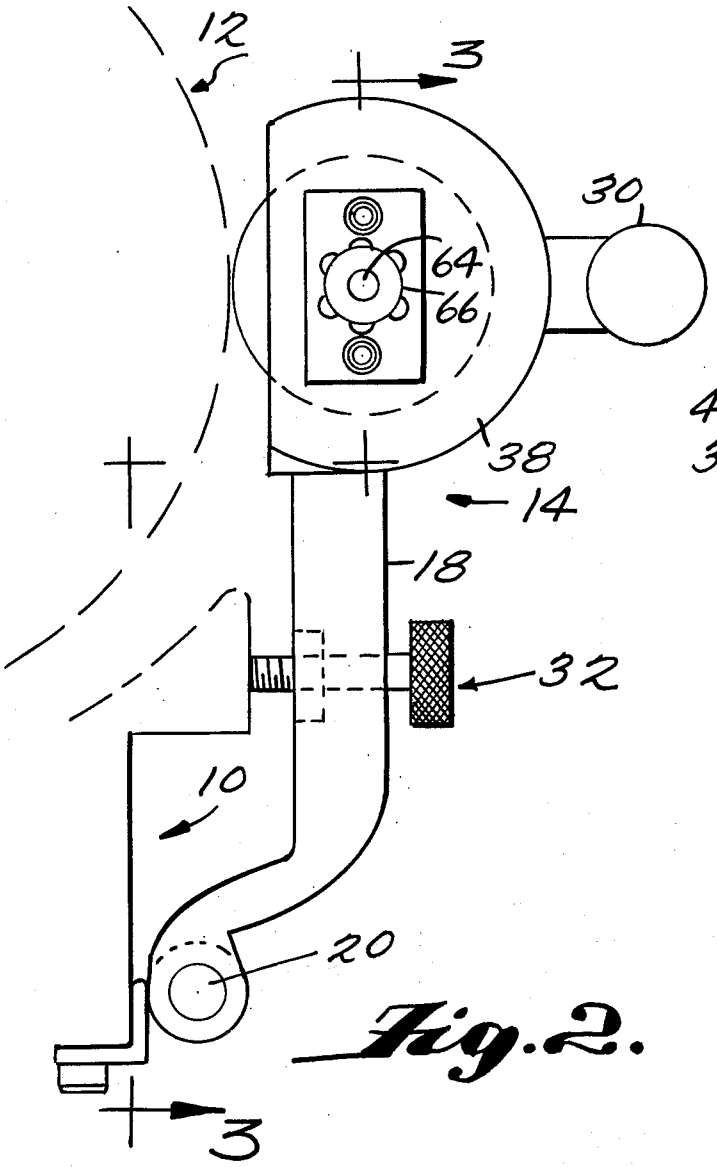
FIG. 2 is a side elevation of the sharpener of FIG. 1.

In FIG. 2 the sharpening assembly 14 is shown in its operative position in which the stone 16 is being rotated by the rasp 12. An adjustable stop arrangement 32 between the machine frame 10 and the arm 18 limits the approach of the stone 16 toward the rasp 12. This prevents over-sharpening, that is excessive removal of metal from the rasp teeth. The ajustable nature of the stop also compensates for wear of the stone 16 in that it permits the arm to be moved closer to the rasp 12 as the surface of the stone 16 wears away during use.

The stone 16 is freely rotatable on a non-rotating shaft 34 the ends of which are supported in the end walls 36, 38 of a frame by means of flange bearings 40, 42. The end walls 36, 38 form part of the guard 28. The stone 16 is mounted on the shaft 34 by flange bearings 44, which are locked to the ends of the stone 16 by lock washers 48. A first thrust bearing 50, 52 surrounds the flange portions of the two flange bearings 40, 48 and a second thrust bearing 54, 56 surrounds the flange portions of the flange bearings 42, 46. The bearing portions 52 and 54 rotate with the stone 16 and bear against the bearing portions 50, 56 which do not rotate.

Figure 3:
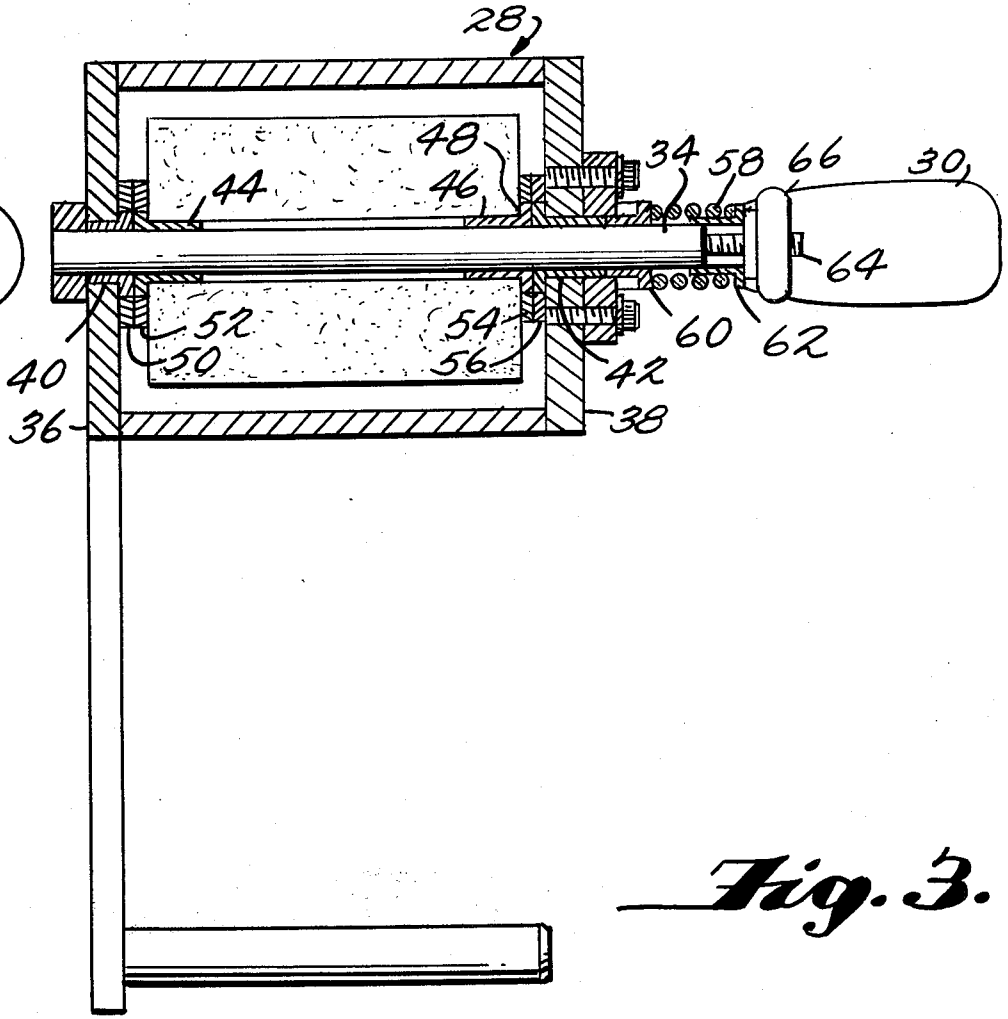
FIG. 3 is a sectional view taken on the line 3—3 of FIG. 2.

The stone 16 is biased to the left as viewed in FIG. 3 by a compression spring 58 which surrounds the right hand end of the shaft 34 at a location between two flange bearings 60, 62. A threaded stud 64 projects axially from the end of the shaft 34 and receives an interiorly threaded knob 66 which bears against the bearing 62. Rotation of the knob 66 in a direction to screw it further onto the stud 64 compresses the spring 58 and this force is transmitted through the flange bearing 60 and the flange bearing 42 to the stone 16 and its bearings 44 and 46. The axial forces on the thrust bearing parts 50, 52 and 54, 56 are thereby increased with the result that the stone 16 turns more slowly than the rasp 12. The flange bearings 44, 46, 42, 60, and 62 are slidable on the shaft 34 to enable the forces on the thrust bearings to be adjusted by this arrangement.

In use of the sharpening device the machine operator turns the power drive to the rasp 12 on and then off. While the rasp continues to rotate by its own inertia the operator grasps the handle 30 and swings the arm 18 upwardly toward the rasp 12 to engage the periphery of the stone 16 with the moving rasp teeth. The stop 32 limits the extent of engagement so as to prevent excessive wear of the teeth and of the stone 16. The stone 16 is caused to rotate by the moving rasp teeth and the operator can adjust the speed of the stone 16 by adjusting the position of the knob 66 on the stud 64. For accurate uniform sharpening the stone 16 should turn much more slowly than the rasp 12 and this is readily accomplished by means of the adjustable spring biased brake mechanism under the control of the operator. When sharpening is completed the arm 18 is swung away from the rasp 12, and if desired it may be removed from the machine by first removing the collar 24 on the shaft portion 20 of the assembly.

Modifications of the illustrated apparatus may be made without departing from the scope of the invention which is described in the claims.

What is claimed is:

1. In a tire buffing machine including a frame and a rotatably driven rasp having cutting edges, a sharpening device comprising a cylindrical abrasive sharpening stone mounted for rotation about its axis on one end of an arm, means mounting the other end of the arm to the machine frame for swinging movement toward and away from the rasp so that the periphery of the stone may be brought into engagement with the moving cutting edges of the rasp in a position to be rotated by said edges while sharpening the same, and a spring adjustable brake mechanism capable of being adjusted by an operator for applying controlled variable resistance to rotation of the stone such that the stone rotates more slowly than the rasp.

2. Apparatus as in claim 1 including an adjustable stop assembly between said arm and said machine frame for limiting movement of said arm in a direction toward said rasp to thereby prevent over-sharpening of said rasp.

3. In a tire buffing machine including a frame and a rotatably driven rasp having cutting edges, a sharpening device comprising a cylindrical abrasive sharpening stone disposed with its axis parallel to the axis of rotation of the rasp and mounted for rotation about its axis on one end of an arm, means detachably mounting the other end of the arm to the machine frame for swinging movement about an axis parallel to the axis of rotation of the rasp for movement toward and away from the rasp so that the periphery of the stone may be brought into engagement with the moving cutting edges of the rasp in a position to be rotated by said edges while sharpening the same, a spring biased adjustable brake mechanism for applying controlled variable resistance to rotation of the stone such that the stone rotates more slowly than the rasp; a protective guard carried by the arm and surrounding that side of the stone facing away from the rasp, an adjustable stop device which limits movement of the arm toward the rasp for preventing damage to the latter by the stone and for compensating for wear of the stone after prolonged use; and a handle for use by an operator in swinging the arm toward and away from the rasp.

4. Apparatus as in claim 3 wherein said brake mechanism includes a thrust bearing assembly at each end of the stone, each assembly having first and second engaging parts which are spring biased toward each other, and means for adjusting the biasing force.

5. A rasp sharpener for sharpening the blades of a rotating rasp on a tire buffing machine comprising a cylindrical abrasive sharpening stone mounted for free rotation about its axis on one end of an arm; and manually adjustable brake means carried by the arm for variably restraining free rotation of the stone, said brake mechanism including a thrust bearing assembly at each end of the stone, each assembly having first and second engaging parts which are spring biased toward each other, and means for adjusting the biasing force.

6. A rasp sharpener for sharpening the blades of a rotating rasp on a tire buffing machine comprising a cylindrical abrasive sharpening stone freely rotatable and slidable on a shaft passing through the stone; a frame assembly supporting the ends of the shaft; a thrust bearing assembly at each end of the stone, each bearing assembly having first and second engaging parts, the first part being carried by the frame adjacent one end of the stone and the second part being rotatable with the stone; means for adjusting the thrust forces in said bearing, said means including a compression spring biasing one of said first bearing parts toward its respective second bearing part thereby biasing the second bearing part of the other bearing assembly toward its respective first part and means for manually adjusting the compression in the spring; a supporting arm; means fixing said frame assembly to one end of the arm; and means at the other end of the arm for pivotally mounting the arm for swinging movement about an axis paralell to the axis of the shaft.

7. Apparatus as in claim 1 wherein said sharpening stone is mounted for rotation on a non-rotating shaft and wherein said brake mechanism is arranged to apply adjustable forces to said stone.

8. Apparatus as in claim 1 wherein said brake mechanism includes a thrust bearing assembly at each end of the stone, each assembly having first and second engaging parts which are spring biased toward each other, and means for adjusting the biasing force.

9. In a tire buffing machine including a frame and a rotatably driven rasp having cutting edges, a sharpening device comprising a cylindrical abrasive sharpening stone disposed with its axis parallel to the axis of rotation of the rasp; means mounting said stone for rotation about its axis on one end of an arm, means detachably mounting the other end of the arm to the machine frame for swinging movement about an axis parallel to the axis of rotation of the rasp for movement toward and away from the rasp so that the periphery of the stone may be brought into engagement with the moving cutting edges of the rasp in a position to be rotated by said edges while sharpening the same, an adjustable brake mechanism for applying controlled variable resistance to rotation of the stone such that the stone rotates more slowly than the rasp; means carried by said mounting means for adjusting said brake mechanism; a protective guard carried by the arm and surrounding that side of the stone facing away from the rasp; and a handle for use by an operator in swinging the arm toward and away from the rasp.

* * * * *